US006152560A

United States Patent [19]

Hollands

[11] Patent Number: 6,152,560

[45] Date of Patent: Nov. 28, 2000

[54] INK JET DEVICE WITH A FILTER ELEMENT

[75] Inventor: Peter Joseph Hollands, Baarlo, Netherlands

[73] Assignee: Oce-Technologies B.V., Netherlands

[21] Appl. No.: 09/235,552

[22] Filed: Jan. 22, 1999

[30] Foreign Application Priority Data

Jan. 23, 1998 [EP] European Pat. Off. ..... 98200188

[51] Int. Cl.[7] ..... B41J 2/175

[52] U.S. Cl. ..... 347/93

[58] Field of Search ..... 347/85, 86, 87, 347/93, 92

[56] References Cited

U.S. PATENT DOCUMENTS

| | | | |
|---|---|---|---|
| 5,477,256 | 12/1995 | Loyd et al. | 347/93 |
| 5,502,479 | 3/1996 | Ishinaga et al. | 347/93 |
| 5,537,136 | 7/1996 | Brandon et al. | 347/87 |
| 5,841,455 | 11/1998 | Tanaka et al. | 347/87 |
| 5,971,531 | 10/1999 | Dietl et al. | 347/86 |

FOREIGN PATENT DOCUMENTS

| | | |
|---|---|---|
| 0488829A2 | 6/1992 | European Pat. Off. . |
| 0603902A2 | 6/1994 | European Pat. Off. . |
| 0730966A2 | 9/1996 | European Pat. Off. . |
| 0791464A2 | 8/1997 | European Pat. Off. . |

OTHER PUBLICATIONS

Japanese Abstract; 59/033154; Feb. 22, 1984.
Japanese Abstract; 08/267778; Oct. 15, 1996.
Japanese Abstract; 01/133747; May 25, 1989.
Japanese Abstract; 06/326447; Nov. 25, 1994.

*Primary Examiner*—N. Le
*Assistant Examiner*—Michael Nghiem
*Attorney, Agent, or Firm*—Birch, Stewart, Kolasch & Birch, LLP

[57] ABSTRACT

An ink jet device including an ink reservoir and a filter element made of a sheet-like material having a curved shape and sealingly disposed in a port of the ink reservoir, wherein the filter element is inserted in the port in an elastically deformed state and is held in engagement with the walls of this port by its elastic restoration forces.

17 Claims, 1 Drawing Sheet

INK JET DEVICE WITH A FILTER ELEMENT

BACKGROUND OF THE INVENTION

The present invention relates to an ink jet device comprising an ink reservoir and a filter element made of a sheet-like material having a curved shape and sealingly disposed in a port of the ink reservoir.

In an ink jet device, such as an ink jet printer, an ink reservoir is incorporated in the printhead or in a separate cartridge and serves to accommodate a certain amount of liquid ink which is to be supplied to a nozzle system of the printhead. In order to prevent the nozzle system from becoming clogged with particulate matter, a filter element is disposed either in an inlet port or an outlet port of the ink reservoir so that the ink is filtered before it is supplied to the nozzle system. The port should be sealed by the filter element so that the ink does not leak around the filter element.

U.S. Pat. No. 5,537,136 discloses an ink jet device of the type indicated above wherein the filter element is a stainless steel wire mesh which has a spherically curved shape. U.S. Pat. No. 5,502,479 and EP-A-0 603 902 disclose similar ink jet devices in which the filter element is bent into a cylindrical shape to form a slitted tubular member.

In these known devices the filter element is secured in the port of the ink reservoir by means of an adhesive, by welding or by injection molding techniques. For example, as is disclosed in U.S. Pat. No. 5,537,136, the edge of the dome-shaped filter element is imbedded in an elastomeric material by injection molding, so that a self-sealing cap is formed which is placed over the port of the ink reservoir.

SUMMARY OF THE INVENTION

It is an object of the present invention to provide an ink jet device of the type indicated above which can be manufactured more efficiently.

According to the present invention, the filter element is inserted in the port of the ink reservoir in an elastically formed state and is held in engagement with the walls of the port by its elastic restoration forces.

Thus, the filter element can be mounted by simply inserting it into the port in a slightly compressed state, and elastic restoration forces of the filter element cause the filter element to expand again and to sealingly engage the walls of the port. As a result, the use of an adhesive, welding or molding techniques are not required for securely mounting filter element.

In a preferred embodiment the filter element, which may be a woven or non-woven fabric of stainless steel fibers, has a tubular shape and is inserted into a channel defined between opposing walls of the port of the ink reservoir. Preferably, the walls of this channel are matched to the tubular shape of the filter element, so that the filter element will sealingly engage the walls of the channel in a larger surface area.

In a particularly preferred embodiment, the port of the ink reservoir has a rectangular cross-section, and the channel extends in parallel with the longer sides of this rectangular cross-section. Both ends of the channel are prolonged by recesses or holes formed in the shorter side walls of the port, so that both ends of the tubular filter element can be accommodated in these recesses or holes. At least one end of the channel is formed as a through-hole in the side wall of the port, so that the filter element can be inserted into the channel through this through-hole which may then be closed with a plug or the like.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
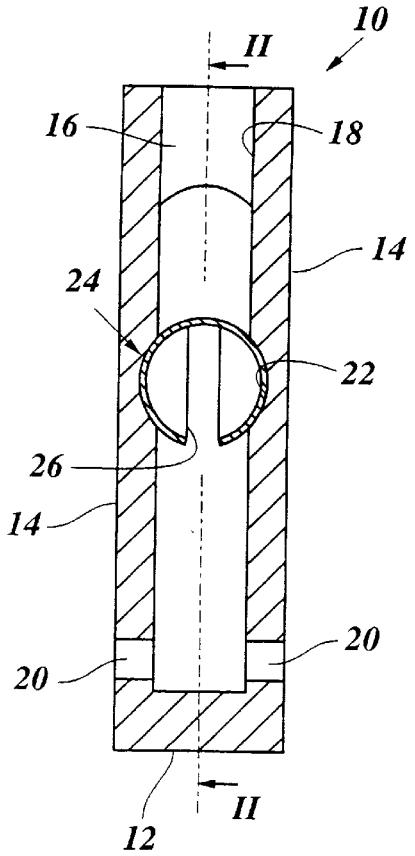
FIG. 1 is a cross-sectional view of an ink reservoir and a filter element of an ink jet device.

An ink reservoir 10 in an ink cartridge or a printhead of an ink jet printer is formed by a casing having a bottom wall 12, two parallel longer side walls 14 and two parallel shorter side walls 16. In the top part of the ink reservoir, the side walls 14,16 define an inlet port 18 which has an elongated rectangular cross-section when viewed from above. Liquid ink can be filled into the ink reservoir 10 through the inlet port 18. Outlet ports 20, through which the ink is supplied to a nozzle system (not shown) of the printhead, are formed as elongate slots in the side walls 14 close to the bottom wall 12.

In a portion of the inlet port 18 the internal surfaces of the longer side walls 14 are formed with elongate recesses which have the cross-sectional shape of a segment of a circle and are mutually opposed to each other so that they define a cylindrical channel 22 which extends in parallel with the side walls 14. This channel 22 accommodates a filter element 24.

The filter element 24 is formed by a rectangular sheet of stainless steel mesh or fabric which has been rolled or bent into a tubular shape, so that it has the configuration of a circular cylinder with a longitudinal slit 26.

Figure 2:
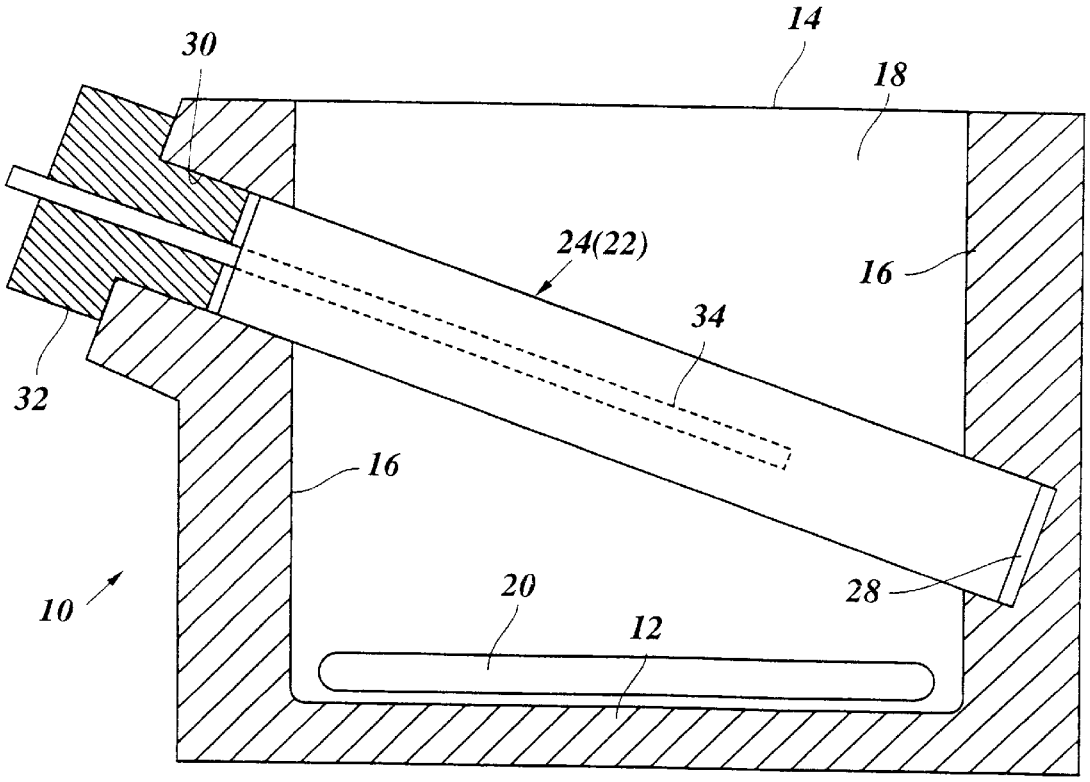
FIG. 2 is a longitudinal section of the ink reservoir with the filter element disposed therein.

As is shown in FIG. 2, the channel accommodating the filter element 24 is slightly inclined and is extended into the shorter side walls 16 of the ink reservoir. The lower end of the channel 22 terminates in a blind hole or recess 28 in one of the side walls 16, whereas the other end of the channel is formed as a through-hole 30 penetrating the other side wall 16. The opposite ends of the tubular filter element 24 are accommodated in the recess 28 and the through-hole 30, respectively, so that the total cross-section of the port 18 is completely blocked by the filter element, and the mesh of the filter element is in surface-to-surface engagement with the internal surfaces of the recess 28, the through-hole 30 and the portions of the side walls 14 defining the channel 22. Thus, the ink liquid introduced through the port 18 is forced to pass through the filter element 24 and is prevented from leaking around the filter element.

The through-hole 30 is closed by a plug 32. In the shown embodiment a rod-like sensor element 34 is imbedded in the plug 32 and extends coaxially in the tubular filter element 24. This sensor element 34 may, for example, serve as a level detector for detecting the level of the ink liquid in the ink reservoir or the port 18 thereof or, in the case of a hot-melt ink jet device, as a temperature sensor for monitoring the temperature of the hot-melt ink.

The metal mesh forming the filter element 24 has a certain elasticity, and the tubular filter element, in its natural state, has a radius of curvature which is slightly larger than the one shown in FIG. 1. When the filter element is mounted in the ink reservoir 10, it is slightly compressed in lateral direction in FIG. 1, so that the slit 26 becomes narrower and the filter element can be inserted into the channel 22 through the through-hole 30. Then, due to its own elasticity, the filter element 24 tends to flex back into its natural state, until its outer surface firmly engages the internal surfaces of the channel 22. The filter element 24 is then held in the channel 22 in a slightly compressed state. In this way, the filter element can be firmly secured in the ink reservoir 10 without the aid of any adhesive and without employing any other bonding techniques. The assembly is completed by inserting the plug 32 with the sensor element 34 into the filter element.

Under normal conditions the elasticity is large enough to ensure an ink-tight contact between the filter element and the ink reservoir. However, It is possible to enhance this pressure by inserting a pressurizing element into the filter element 24 such as a spiral spring or a long leaf spring.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. An ink reservoir which comprises opposing side walls which define a chamber, inlet means for introducing ink into said chamber and outlet means for removing ink from said chamber, and a filter element having a curved periphery disposed in said chamber between said inlet and outlet means, said filter element being elastically deformable for tight, lateral compression and engagement of the curved periphery with said opposing side walls whereby said filter element is fixedly secured within said chamber.

2. The ink reservoir of claim 1, wherein the filter element is made of a sheet-like material.

3. The ink reservoir of claim 1, wherein the filter element has a tubular configuration.

4. The ink device of claim 3, wherein the opposing side walls contain mutually opposing channels in which the filter element is accommodated.

5. The ink reservoir of claim 4, wherein the opposing channels have the cross-sectional shape of a segment of a circle and define a cylindrical channel which extends in parallel with the side walls.

6. The ink reservoir of claim 4, wherein the channels are inclined as they extend across said chamber, whereby the filter element is diagonally disposed across said chamber between the inlet means and outlet means.

7. The ink device of claim 3, wherein the tubular filter element has a longitudinal slit.

8. The ink device of claim 1, wherein the inlet means is an inlet port having an elongated rectangular shape and the filter element extends in parallel with the opposing side walls.

9. The ink device of claim 1, wherein the chamber is further defined by opposing, short side walls, one side wall containing a recess and the other side wall containing a through-hole whereby the filter element extends through said through-hole and is secured in said recess, thereby completely dividing the chamber between the inlet means and outlet means.

10. The ink reservoir of claim 9, wherein the through-hole is closed by a plug.

11. The ink reservoir of claim 10, wherein a sensor element is disposed in the plug and extends into the filter element.

12. The ink reservoir of claim 11, wherein the sensor is a level detector or a temperature sensor.

13. The ink reservoir of claim 1, wherein the filter element is made of a metal mesh or fabric of metal fibers.

14. The ink reservoir of claim 1, further containing a spiral spacing or a leaf spring disposed in said filter element.

15. An ink jet device containing an ink reservoir which includes opposing side walls which define a chamber, inlet means for introducing ink into said chamber and outlet means for removing ink from said chamber, and a filter element having a curved periphery disposed in said chamber between said inlet and outlet means, said filter element being elastically deformable for tight, lateral compression and engagement of the curved periphery with said opposing side walls whereby said filter element is fixedly secured within said chamber.

16. The device of claim 15, wherein the ink jet device is an ink jet printer.

17. An ink reservoir which comprises opposing side walls and opposing end walls which define a chamber, inlet means for introducing ink into said chamber and outlet means for removing ink from said chamber, recesses provided in said opposing end walls, and a filter element disposed in said chamber between said inlet and outlet means, said filter element extending across said chamber for engagement within said recesses, said filter element being elastically deformable for tight lateral compression and engagement with said opposing side walls, whereby said filter element is fixedly secured within said chamber.

* * * * *